US006447302B1

(12) United States Patent
Davis

(10) Patent No.: US 6,447,302 B1
(45) Date of Patent: Sep. 10, 2002

(54) TOWING CONNECTOR

(75) Inventor: Gerald Davis, Cottonwood Falls, KS (US)

(73) Assignee: Hopkins Manufacturing Corporation, Emporia, KS (US)

( * ) Notice: Subject to any disclaimer, the term of this patent is extended or adjusted under 35 U.S.C. 154(b) by 0 days.

(21) Appl. No.: 09/695,268

(22) Filed: Oct. 24, 2000

(51) Int. Cl.[7] ..... H01R 33/00
(52) U.S. Cl. ..... 439/34; 439/35
(58) Field of Search ..... 439/34, 35, 653, 439/638, 639, 650, 651, 652, 654, 656, 540.1, 655

(56) References Cited

U.S. PATENT DOCUMENTS 4,179,179 A * 12/1979 Lowden ..... 439/278
4,299,434 A * 11/1981 Ishikawa ..... 439/394
4,775,802 A * 10/1988 Dods ..... 307/147
5,354,204 A * 10/1994 Hughes ..... 439/35
5,443,389 A 8/1995 Hughes ..... 439/35
5,601,451 A * 2/1997 Driones et al. ..... 439/490
5,626,479 A * 5/1997 Hughes ..... 439/35

* cited by examiner

*Primary Examiner*—P. Austin Bradley
*Assistant Examiner*—Ross Gushi
(74) *Attorney, Agent, or Firm*—Hovey Williams LLP

(57) ABSTRACT

An electrical interface device (10) is provided for attachment to a towing vehicle (14) in order to allow the connection of the electrical systems of differently configured towed vehicles without any modification of the device (10). The device (10) includes a receptacle body (18) having a circular receptacle (22) and a flat receptacle (24), together with an electrical lead assembly (20) allowing connection of the device (10) to the electrical system of the towing vehicle (14). Individual covers (112, 114) are pivotally supported on the body (18) and allow individual access to the different receptacles (22, 24). In preferred forms, the circular receptacle (22) includes a central terminal (54) as well as six circularly arranged terminals (62) disposed about the terminal (54). The flat receptacle (24) has four aligned terminals, three female terminals (68–72) and a male terminal (74). The interface device (10) thus allows proper electrical connection of most types of towed vehicles to the electrical system of the towing vehicle (14).

14 Claims, 3 Drawing Sheets

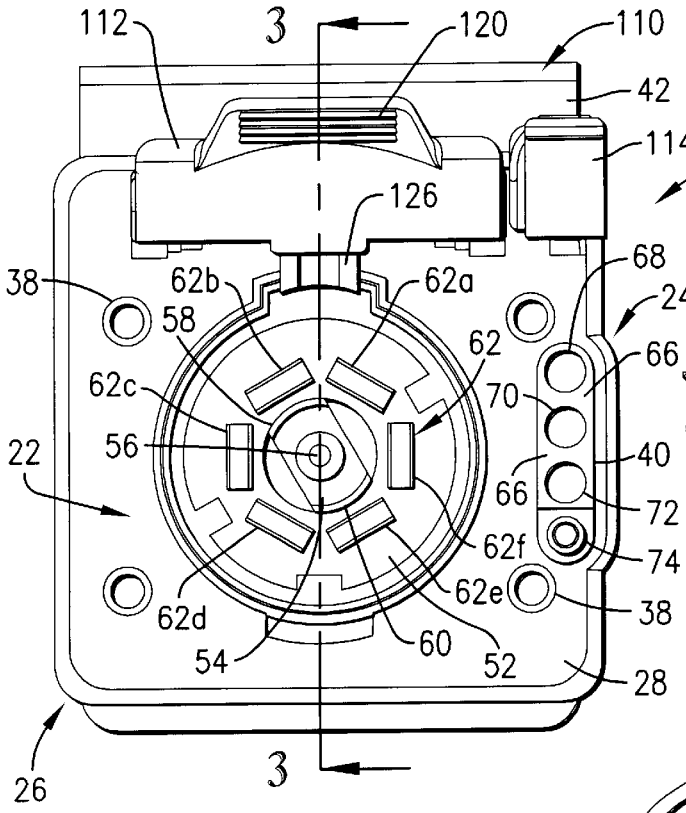
FIG. 2
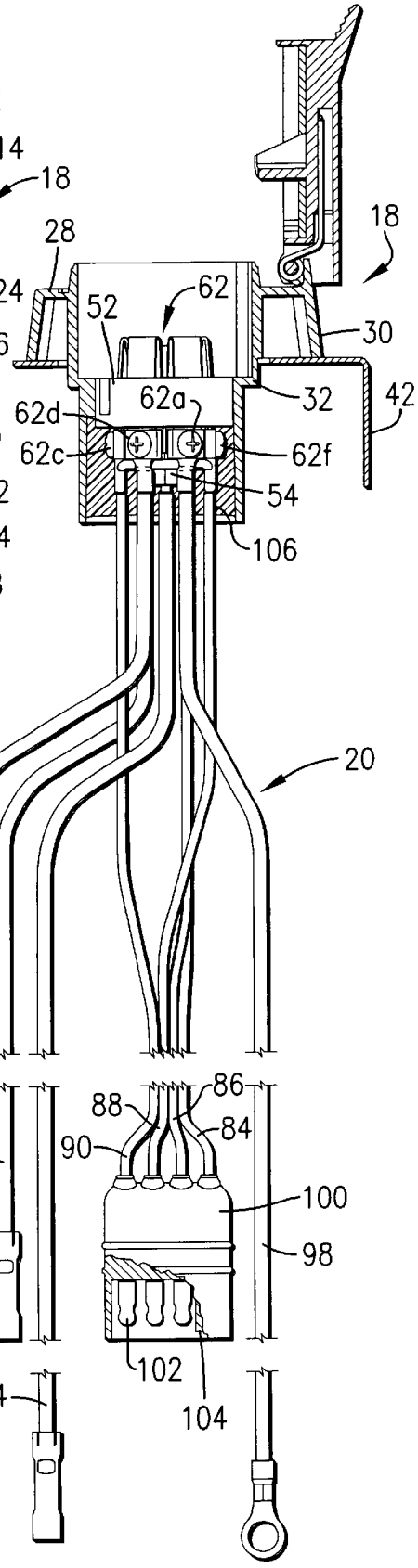
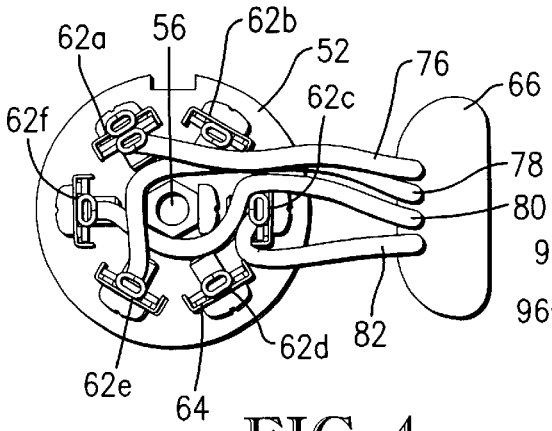
FIG. 4
FIG. 3

TOWING CONNECTOR

BACKGROUND OF THE INVENTION

1. Field of the Invention

The present invention is broadly concerned with electrical interface devices designed to be mounted upon a towing vehicle so as to facilitate the electrical connection between the electrical systems of the towing vehicle and a towed vehicle. More particularly, the invention pertains to such interface devices which are designed to accommodate different types of towed vehicle electrical connectors, all without any modification of the interface device. In this fashion the interface devices of the invention may be used with towed vehicles having different types of electrical system connectors.

2. Description of the Prior Art

In recent years, the rising popularity of outdoor recreational activities, such as boating and camping, has led to an increase in the use of trailers, campers, boats and other towed vehicles. Many state and federal laws require that towed vehicles have on-board electrical systems for providing brake lights, turn signals and other safety features. These on-board electrical systems are usually controlled by the electrical system of the towing vehicle, to actuate appropriate electrical signals on the towed vehicle. For example, when the brake lights on the towing vehicle are energized, the brake lights on the towed vehicle are simultaneously energized. This is also true for the turn signals and backup lights of the two vehicles.

Typically, a hard-wired electrical connection is installed to enable slaving the responsive electrical system of the towed vehicle to the electrical signals generated by the towing vehicle. Hard-wired electrical connections typically include a plurality of mating plug and receptacle connections to enable the user to readily make and break the electrical connection. Commonly, each vehicle includes a wiring harness, to which the mating plug and receptacle connections are secured. Each wiring harness includes a harness connector with male and/or female terminals in a pin and/or blade configuration in order to establish a releasable electrical interconnection between the wiring harness on the towing vehicle and a wiring harness on the towed vehicle. The towed vehicle typically employs a wiring harness having an array of male or female pin terminals for releasable insertion into a complemental array of male or female pin terminals connected to the wiring harness on the towing vehicle.

Early wiring harnesses comprised relatively simple harness connectors having four terminals arranged in a spaced, linear arrangement, mounted in a flat harness component. Such early connectors were sufficient for handling low current requirements of simple electrical systems. However, with the proliferation of ever more sophisticated towed vehicles, equipped with many more complex accessories, electrical harness connectors having six or seven wires are becoming common on both towing and towed vehicles. Furthermore, such modern-day harness connectors are often of circular design in order to effectively accommodate the more numerous terminals required for the additional wires.

U.S. Pat. No. 5,443,389 describes a unified connector interface device wherein provision is made for a circular connector in the form of an appropriately configured socket-type receptacle. While this device is suitable for use with towed vehicles having such circular connectors, it does not provide for flat connectors without modification. That is, in the '389 patent, a cable with a flat coupler is normally plugged into the rear of the interface device in order to afford the proper electrical connection thereto. However, with a towed vehicle having a flat plug connector, it is necessary to detach this flat coupler and use it directly with the flat connector. This is not only troublesome, but also results in a condition where the attached electrical connectors of the towing and towed vehicles are in a suspended, exposed position where separation of and/or damage to the connectors can more readily occur.

SUMMARY OF THE INVENTION

The present invention overcomes the problems outlined above, and provides an improved electrical interface device designed for quick, easy connection between the electrical system of a towing vehicle and that of a plurality of differently configured towed vehicles, without any modification whatsoever of the interface device. The preferred interface device broadly comprises a body for mounting on the towing vehicle, the body having first and second ends; the first end presenting both a circular receptacle and a second linear or flat receptacle, with each of the receptacles including individual electrical terminals. The circular and flat receptacles are adapted to receive corresponding complemental electrical connectors forming a part of the electrical system of a respective towed vehicle. An electrical lead assembly is operatively coupled with the individual terminals and has a plurality of leads connectable to the electrical system of the towing vehicle. The lead assembly and terminals are coupled such that a complemental towed vehicle electrical connector attached to either of the receptacles will interconnect the electrical systems of the towing and towed vehicles.

In preferred forms, the circular receptacle is of the conventional variety and includes a central terminal as well as six circularly arranged terminals disposed about the central terminal. Of course, other terminal designs and/or terminal arrangements could also be provided. For example, a conventional adaptor can convert a conventional seven-round connector to a six-round connector. The flat receptacle is likewise preferably of conventional design and includes four linearly aligned terminals, three of such terminals being female while the remaining terminal is a male terminal. Advantageously, there are electrical wires coupling the terminals of the flat receptacle with certain of the terminals of the circular receptacle. Preferably, the shared electrical connections are connected in parallel.

In order to provide weather protection, the interface device has individually operable covers associated with the circular and flat receptacles, respectively. These individual covers are hingedly mounted to the main body of the device, and can be separately opened to allow access to the corresponding receptacle.

BRIEF DESCRIPTION OF THE DRAWINGS

FIG. 2 is a front elevational view of the interface device, with the individual covers thereof open to reveal the alternate receptacles;

FIG. 3 is a sectional view taken along line 3—3 of FIG. 2 and depicting details of the internal construction of the interface device;

FIG. 4 is a fragmentary view illustrating the rear face of the circular receptacle of the interface device, and depicting the electrical interconnection of the flat and circular receptacles;

Figure 1:
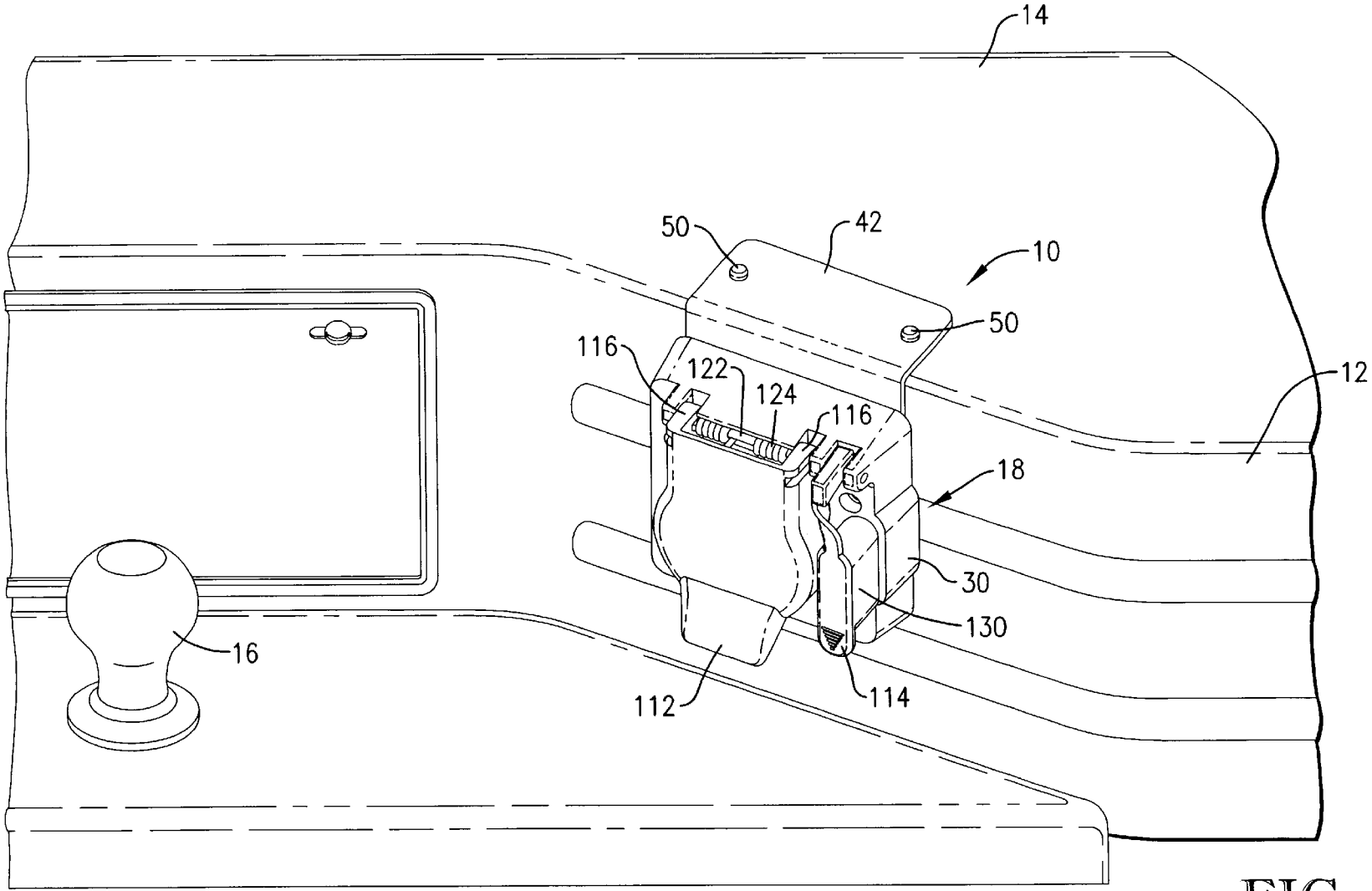
FIG. 1 is an elevational view of a preferred electrical interface device, mounted upon the bumper of a towing vehicle.

The drawing figures do not limit the present invention to the specific embodiments disclosed and described herein. The drawings are not necessarily to scale, emphasis instead being placed upon clearly illustrating the principles of the invention.

DETAILED DESCRIPTION OF A PREFERRED EMBODIMENT

Turning now to the drawings, FIG. 1 illustrates an electrical interface device 10 mounted on the bumper 12 of a towing vehicle 14, the latter equipped with a conventional hitch 16. The purpose of the device 10 is to provide an appropriate electrical connection between the electrical system of the vehicle 14 and that of a towed vehicle such as a boat or travel trailer. A particular feature of the device 10 is the ability to accept a plurality of different connectors associated with the electrical systems of different types of towed vehicles, without modification of the device 10. In this way, a user may use the device 10 for electrically connecting the systems of divergent towed vehicles.

It should be noted that the present invention is for the electrical interface device 10 independent of any particular mounting location, arrangement, or means. Thus, the device 10 may be alternatively mounted under the bumper 12, through the bumper 12, on a hitch crossbar (not shown), on orthrough a rear body portion of the towing vehicle 14, or any other suitable location using any practical mounting means.

The device 10 broadly includes a receptacle body 18 having first and second ends 18*a* and 18*b* and adapted to be mounted on the vehicle 14 at any convenient location such as illustrated in FIG. 1, together with an electrical lead assembly 20 which is designed for connection to the electrical system of the towing vehicle 14. The body 18 has a circular receptacle 22 as well as a flat receptacle 24 on the face thereof.

In more detail, the body 18 includes a front segment 26 formed of synthetic resin material and presenting a face plate 28 and a continuous, circumscribing, rearwardly extending sidewall 30. The segment 26 also has a rearwardly extending socket 32 having a pair of spaced apart, elongated, rearwardly extending ribs 34, 36 on the exterior surface thereof. In addition, a series of four annular screw-receiving bosses 38 extend rearwardly from the face plate 28. Finally, the face plate 28 has an elongated, generally oval-shaped opening 40 therein, located astride the socket 32.

Figures 5, 6:
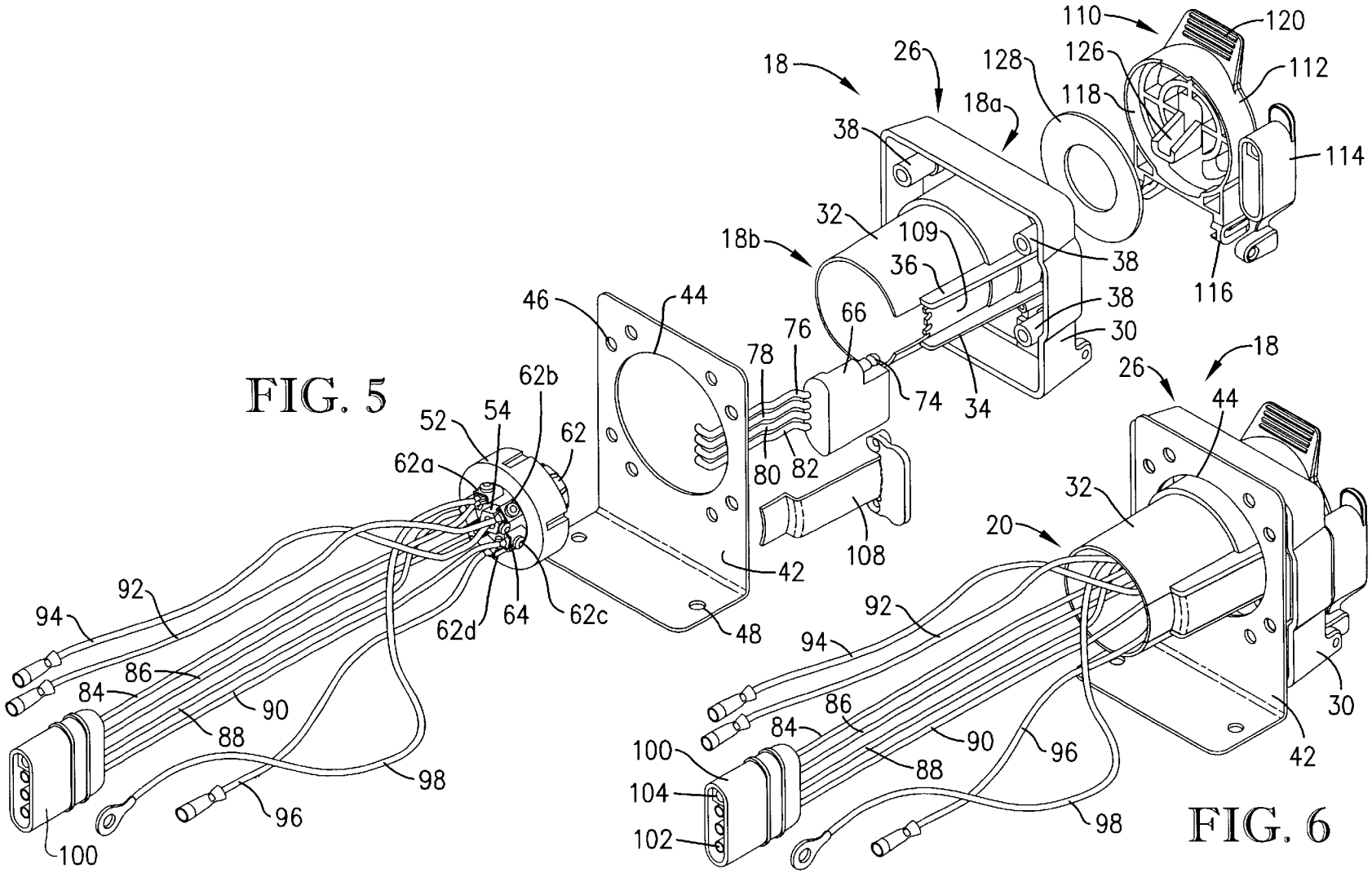
FIG. 5 is an exploded perspective view of the interface device, illustrating the components thereof.
FIG. 6 is a perspective view of the completed interface device, viewed from the rear thereof.

The body 18 also has a generally L-shaped apertured metallic mounting plate 42 secured to the rear face of segment 26. As best seen in FIGS. 5 and 6, the plate 42 has a large central opening 44 therein as well as additional fastener-receiving openings 46. The plate 42 is thus secured to segment 26 by screws received within bosses 38, with the rearwardly extending portion of socket 32 passing through opening 44. As best seen in FIG. 1, the transverse leg of plate 42 has openings 48 therein to accept mounting screws 50.

The circular receptacle 22 includes a synthetic resin, circular terminal member 52 which is received within socket 32. The member 52 has a central terminal 54 secured in place by a fastener 56 and presenting a pair of arcuate, opposed, forwardly extending terminal legs 58, 60. In addition, the receptacle member 52 has a total of six generally U-shaped in cross-section spade-type terminals 62 which are circularly arranged about central terminal 54, labeled terminals 62*a*–62*f*. As illustrated in FIG. 4, each of the terminals 62 has a screw connector 64 on the rear face of member 52.

The flat receptacle 24 is in the form of a molded synthetic resin body 66 which is designed to fit within oval-shaped opening 40 provided in face plate 28. The body 66 includes three aligned openings 68, 70 and 72 having conventional electrical terminals (not shown) in the base thereof. Also, the body supports an elongated metallic male terminal 74 adjacent opening 62.

The lead assembly 20 includes four color-coded electrical leads 76, 78, 80 and 82 respectively electrically coupled with the terminals associated with each of the openings 68–72, and with male terminal 74. As shown in FIG. 5, these leads 76–82 are molded into body 66 and extend rearwardly therefrom. The lead assembly 20 also has a total of eight additional color-coded electrical leads 84, 86, 88, 90, 92, 94, 96 and 98 which are connected to the terminals 54 and 62 of member 52.

The electrical connections of device 10 can best be understood from a consideration of FIGS. 3–5. In particular, it will be seen that the leads 76–82 of flat receptacle 24 are connected to respective ones of the circular member terminals 62, i.e., leads 76 is connected to terminal 62*a*, lead 78 is connected to terminal 62*e*, lead 80 is connected to terminal 62*f* and lead 82 is connected to terminal 62*c*. In like manner, the leads 84–90 are also connected to these same terminals. The ends of the leads 84–90 remote from member 92 are connected to a coupler 100 which is a mate for flat receptacle 24, i.e., it has three male terminals 102 and a female terminal 104 in aligned condition.

The four remaining leads 92–98 are also coupled to member 52, with leads 92–96 secured to terminal connectors associated with the central terminal 54 (lead 94) and terminals 62*b* and 62*d* (leads 92 and 96 respectively); the lead 98 is a ground wire and is connected to the terminal connector associated with terminal 62*a* (see FIG. 5).

In the construction of device 10, the terminal member 52 is located within socket 32 in a recessed condition best illustrated in FIG. 5, with the leads all of assembly 20 extending rearwardly therefrom. An epoxy fill 106 is used to permanently secure and the member 52 within the socket 32, and to seal and weatherproof the connection. Also, the body 66 of flat receptacle 24 is secured to the front segment 26 by means of retainer plate 108 which is secured by fasteners (not shown) to the rear face of segment 26 adjacent opening 40. As shown, the plate 108 extends rearwardly and overlies the ribs 36 and 38, thereby forming a cable way 109 for the leads 76–82 extending from the body 66. The mounting plate 42 is then secured to front segment 26 by means of conventional screw fasteners.

Referring to FIGS. 1 and 5, it will also be observed that the front segment 26 supports the cover-up assembly 110, the latter including a circular receptacle cover 112 and a separate flat receptacle cover 114. The cover 112 includes a pair of laterally spaced apart slotted legs 116, a circular main body portion 118, and a projecting gripper 120. The cover 112 is pivotally supported on segment 26 by means of a metallic hinge pin 122 extending through the legs 116. A torsion spring 124 mounted on the pin 122 bias the cover 112 to its closed position. Referring to FIG. 5, it will be seen that the inner face of cover portion 118 includes an inwardly projecting keeper 126. Also, a resilient elastomeric sealing ring 128 is affixed to the inner surface of portion 118 to provide a weatherproof seal for circular receptacle 22. The flat receptacle cover 114 is formed of a resilient synthetic resin material and has a cap 130 designed to fit over the outwardly projecting body 66. In addition, a flexible connecting tail 132 extends from the cap 130 and is likewise pivotally supported on the pin 122.

In the use of device 10, the unit is first secured in place on a towing vehicle 14 by means of the fasteners 50 at a convenient location, such as on bumper 12. Next, the device is connected to the electrical system of the vehicle 14. This involves securing the coupler 100 to a mating connector forming a part of the electrical system, and then connecting the remaining leads 92–98 to appropriate locations within the electrical system. It will be understood in this respect that most modern-day towing vehicles are designed to accept the coupler 100 and have corresponding wires for connection of the remaining leads. That is, and considering the leads 84–90, the lead 84 is normally a ground wire, whereas leads 86–90 are respectively associated with the tail lights (lead 86) and the left and right turn signals (leads 88 and 90, respectively). As indicated previously, lead 98 is a ground wire. The remaining three leads 92–96 are each associated with back up lights and operation (lead 92), brakes on the towed vehicle (lead 94) and battery (lead 96). In this way, the device 10 is properly integrated into the electrical system of the vehicle 14.

When it is desired to tow a vehicle, the electrical system of the towed vehicle is connected to that of the vehicle 14 through the interface device 10. If the towed vehicle is equipped with a circular connector, cover 112 is opened and the connector is inserted into the circular receptacle 22. In this condition, the keeper 126 serves to retain the circular connector in place. Alternately, if the towed vehicle has a flat connector, the cover 114 is opened and the flat connector is inserted into the corresponding flat receptacle 24. In either case connection in this manner serves to properly electrically interconnect the electrical systems of the two vehicles, without any modification of the interface device 10.

Although the invention has been described with reference to the preferred embodiment illustrated in the attached drawing figures, it is noted that equivalents may be employed and substitutions made herein without departing from the scope of the invention as recited in the claims. For example, as noted above, the electrical interface device 10 is independent of any particular mounting location, arrangement, or means and is not limited to the particular mounting described and shown in detail herein.

Having thus described the preferred embodiment of the invention, what is claimed as new and desired to be protected by Letters Patent includes the following:

What is claimed is:

1. An electrical interface device for connecting a master electrical system of a towing vehicle to a slave electrical system of a towed vehicle, the slave electrical system including one of a plurality of different types of slave connectors, the electrical interface device comprising:

a body for mounting on the towing vehicle;

a first master connector incorporated into the body and connectable to the master electrical system and operable to detachably couple with a first type of slave connector; and a second master connector incorporated into the body and connectable to the master electrical system and operable to detachably couple with a second type of slave connector.

2. The electrical interface device as set forth in claim 1, the first master connector comprising a circular receptacle and a plurality of electrical terminals, the electrical terminals including a central terminal and six additional terminals arranged concentrically about the central terminal.

3. The electrical interface device as set forth in claim 1, the second master connector comprising a plurality of electrical terminals arranged linearly, the electrical terminals including three female terminals and a male terminal.

4. The electrical interface device as set forth in claim 1, further including a plurality of electrical leads connectable at a first end to the master electrical system and connected at a second end to the body, with the first and second master connectors each presenting a plurality of electrical terminals connected to and corresponding to one or more of the electrical leads.

5. An electrical interface device for connecting a master electrical system of a towing vehicle to a slave electrical system of a towed vehicle, the slave electrical system including one of a plurality of different types of slave connectors, the electrical interface device comprising:

a body for mounting on the towing vehicle;

a plurality of electrical leads connectable at a first end to the master electrical system and connected at a second end to the body:

a circular electrical connector incorporated into the body and presenting a plurality of first electrical terminals connected to and corresponding to one or more of the electrical leads, the circular electrical connector operable to detachably couple with a first type of slave connector; and a flat electrical connector incorporated into the body and presenting a plurality of second electrical terminals connected to and corresponding to one or more of the electrical leads, the flat electrical connector operable to detachably couple with a second type of slave connector.

6. The electrical interface device as set forth in claim 5, the first electrical terminals including a central terminal and six additional terminals arranged concentrically about the central terminal.

7. The electrical interface device as set forth in claim 5, the second electrical terminals being arranged linearly and including three female terminals and a male terminal.

8. The electrical interface device as set forth in claim 5, each electrical connector being protectively covered by a removable cover connected to the body.

9. An electrical interface device for connecting a master electrical system of a towing vehicle to a slave electrical system of a towed vehicle, the slave electrical system including one of a plurality of different types of slave connectors, the electrical interface device comprising:

a body adapted for mounting on the towing vehicle;

a plurality of electrical leads having first and second ends, with the first ends being electrically connectable to the master electrical system;

a first master connector incorporated into the body and electrically connectable to the master electrical system via the second ends of the plurality of electrical leads, wherein the first master connector is operable to detachably couple with a first type of slave connector; and a second master connector incorporated into the body adjacent the first master connector and electrically connectable to the master electrical system via the second ends of the plurality of electrical leads, wherein the second master connector is operable to detachably couple with a second type of slave connector.

10. The electrical interface device as set forth in claim 4, wherein the first master connector includes a plurality of electrical terminals arranged concentrically about a central electrical terminal.

11. The electrical interface device as set forth in claim 4, wherein the second master connector includes a plurality of electrical terminals arranged linearly.

12. The electrical interface as set forth in claim 4, wherein the second ends of the plurality of electrical leads are sealed in an epoxy fill.

13. The electrical interface device as set forth in claim 4, further including at least one removable cover operable to protectively cover the first and second master connectors.

14. An electrical interface device for connecting a master electrical system of a towing vehicle to a slave electrical system of a towed vehicle, the slave electrical system including one of a plurality of different types of slave connectors, the electrical interface device comprising:

a body adapted for mounting on the towing vehicle;

a plurality of electrical leads having first and second ends, with the first ends being electrically connectable to the master electrical system, and the second ends being sealed in an epoxy fill;

a first master connector including a plurality of electrical terminals arranged concentrically about a central electrical terminal, with the first master connector being incorporated into the body and electrically connectable to the master electrical system via the second ends of the plurality of electrical leads, wherein the first master connector is operable to detachably couple with a first type of slave connector;

a second master connector including a plurality of electrical terminals arranged linearly, with the second master connector being incorporated into the body adjacent the first master connector and electrically connectable to the master electrical system via the second ends of the plurality of electrical leads, wherein the second master connector is operable to detachably couple with a second type of slave connector; and at least one removable cover operable to protectively cover the first and second master connectors.

* * * * *